US006164090A

United States Patent [19]

Lonati et al.

[11] Patent Number: 6,164,090

[45] Date of Patent: Dec. 26, 2000

[54] NEEDLE ACTUATION DEVICE FOR KNITTING MACHINES

[75] Inventors: Francesco Lonati; Tiberio Lonati; Ettore Lonati; Fausto Lonati, all of Brescia, Italy

[73] Assignee: Matec S.p.A., Scandicci, Italy

[21] Appl. No.: 09/450,445

[22] Filed: Nov. 30, 1999

[51] Int. Cl.[7] ..... D04B 15/32

[52] U.S. Cl. ..... 66/57

[58] Field of Search ..... 66/57

[56] References Cited

U.S. PATENT DOCUMENTS

| | | | |
|---|---|---|---|
| 3,795,119 | 3/1974 | Bourgeois | 66/57 |
| 4,068,498 | 1/1978 | Bourgeois | 66/57 |
| 5,335,518 | 8/1994 | Lonati et al. | 66/108 R |

*Primary Examiner*—Andy Falik

*Attorney, Agent, or Firm*—Guido Modiano; Albert Josif; Daniel O'Byrne

[57] ABSTRACT

A needle actuation device for knitting machines, comprising a cam supporting surface which faces a needle supporting element and supports at least one casting-off cam which has a profile arranged at an angle to the direction in which the needle supporting element moves with respect to the cam supporting surface during the operation of the machine. The profile of the casting-off cam can be engaged by a heel of the needles, or of needle pusher elements, which protrudes from the needle supporting element toward the cam supporting surface. The casting-off cam is supported by the cam supporting surface so that it can rotate about a first axis which is substantially perpendicular to the surface of the portion of the needle supporting element that faces in each instance the cam supporting surface and can rotate on command about the first axis in order to vary the inclination of its profile with respect to the direction of motion.

5 Claims, 3 Drawing Sheets

NEEDLE ACTUATION DEVICE FOR KNITTING MACHINES

BACKGROUND OF THE INVENTION

The present invention relates to a needle actuation device for knitting machines particularly for hosiery or the like.

It is known that knitting machines for knitting hosiery or the like are generally constituted by a needle supporting element which can be substantially flat or cylindrical, depending on whether the machine has a rectilinear or circular model; the needle supporting element is faced by a cam supporting surface which supports a plurality of cams for actuating the needles during the operation of the machine.

More particularly, on the face of the needle supporting element that faces the cam supporting surface there is a plurality of mutually parallel slots, each of which accommodates a needle and optionally a needle pusher element. The needles and any needle pusher elements have heels which protrude from the needle supporting element toward the cam supporting surface and can engage in paths formed by the cams. The needle supporting element, during the operation of the machine, is actuated in one direction with respect to the cam supporting surface so that the heels of the needles or of the needle pusher elements engage in said paths, which have portions which are appropriately inclined with respect to the direction of motion in order to cause an alternating motion of the needles along the corresponding slots of the needle supporting element. This alternating motion causes the needles to take up the yarns fed at a feed of the machine and form loops of knitting.

The cam that determines the movement of the needle after said needle has taken up the yarn, at a feed of the machine, is termed casting-off cam because it produces a movement of the needle which forms a new loop of knitting by casting off the previously formed loop of knitting.

The profile of the casting-off cam can be engaged by the heels of the needles or of the needle pusher elements and is inclined with respect to the direction of motion of the needle supporting element with respect to the cam supporting surface indeed in order to achieve this movement of the needle.

In single-cylinder circular hosiery knitting machines, in which the needle supporting element is constituted by the needle cylinder, the casting-off cam, arranged directly after a feed or drop of the machine, causes the lowering of the needles inside the slots formed in the lateral surface of the needle cylinder after said needles have taken up the yarn at the feed or drop.

In many hosiery knitting machines, the casting-off cam is mounted on a slider which can move on command, with respect to the cam supporting surface, in a direction which is parallel to the extension of the slots that accommodates the needles, so as to allow a variation in the extent of the movement of the needles during the formation of new loops of knitting and thus allow a variation in the length of the loops of knitting.

In other machines, the casting-off cam is fixed to the cam supporting surface and the variation in the length of the loops of knitting is achieved by moving the needle supporting element with respect to the cam supporting surface parallel to the extension of the slots that contain the needles.

The profile of the casting-off cams currently used in hosiery knitting machines has a relatively high inclination with respect to the direction of motion of the needle supporting element relative to the cam supporting surface. The high inclination is necessary because during the formation of long loops of knitting the yarn must rest on a reduced number of sinkers or regions of the needle supporting element in order to reduce the friction that contrasts the sliding of the yarn during the formation of the new loops. If this friction is too high, it can lead to the breakage of the yarn or to a stretching of the loops formed previously in the same row of knitting. This high inclination, required in the formation of long loops of knitting, does not allow an increase in the operating speed of the machine, since it would lead to rapid wear of the casting-off cam and of the heels and might also cause the heels of the needles or of the needle pusher elements to break.

SUMMARY OF THE INVENTION

The aim of the present invention is to solve the above-mentioned problem, providing a needle actuation device for knitting machines for hosiery or the like which allows an increase in the operating speed of the machine, particularly during the formation of knitting with short loops, without entailing problems when forming knitting with longer loops.

Within the scope of this aim, an object of the present invention is to provide a device which allows an increase in the productivity of hosiery knitting machines and to also reduce the wear of the heels of the needles or needle pusher elements and of the casting-off cam.

Another object of the present invention is to provide a device which can be installed on a wide range of hosiery knitting machines or the like.

This aim, these objects and others which will become apparent hereinafter are achieved by a needle actuation device for hosiery knitting machines for hosiery or the like, comprising a cam supporting surface which faces a needle supporting element and supports at least one casting-off cam which has a profile arranged at an angle to the direction in which said needle supporting element moves with respect to said cam supporting surface; said profile of the casting-off cam being engageable by a heel of the needles, or of needle pusher elements, which protrudes from said needle supporting element toward said cam supporting surface; said needle supporting element having, on its face directed toward said cam supporting surface, a plurality of slots which run parallel to each other and substantially at right angles to said direction of motion, each slot accommodating a needle which can slide along the corresponding slot; said profile of the casting-off cam being suitable to produce a movement of the needles, along the corresponding slot of the needle supporting element, after the yarn has been taken up at a feed of the machine, in order to form new loops of knitting, casting off the previously formed loops of knitting; characterized in that said casting-off cam is supported by said cam supporting surface so that it can rotate about a first axis which is substantially perpendicular to the surface of the portion of said needle supporting element that faces in each instance said cam supporting surface and can rotate on command about said first axis in order to vary the inclination of said profile with respect to said direction of motion.

BRIEF DESCRIPTION OF THE DRAWINGS

Further characteristics and advantages of the present invention will become apparent from the following detailed description of a preferred but not exclusive embodiment of the device according to the invention, illustrated only by way of non-limitative example in the accompanying drawings, wherein.

DESCRIPTION OF THE PREFERRED EMBODIMENTS

Figure 1:
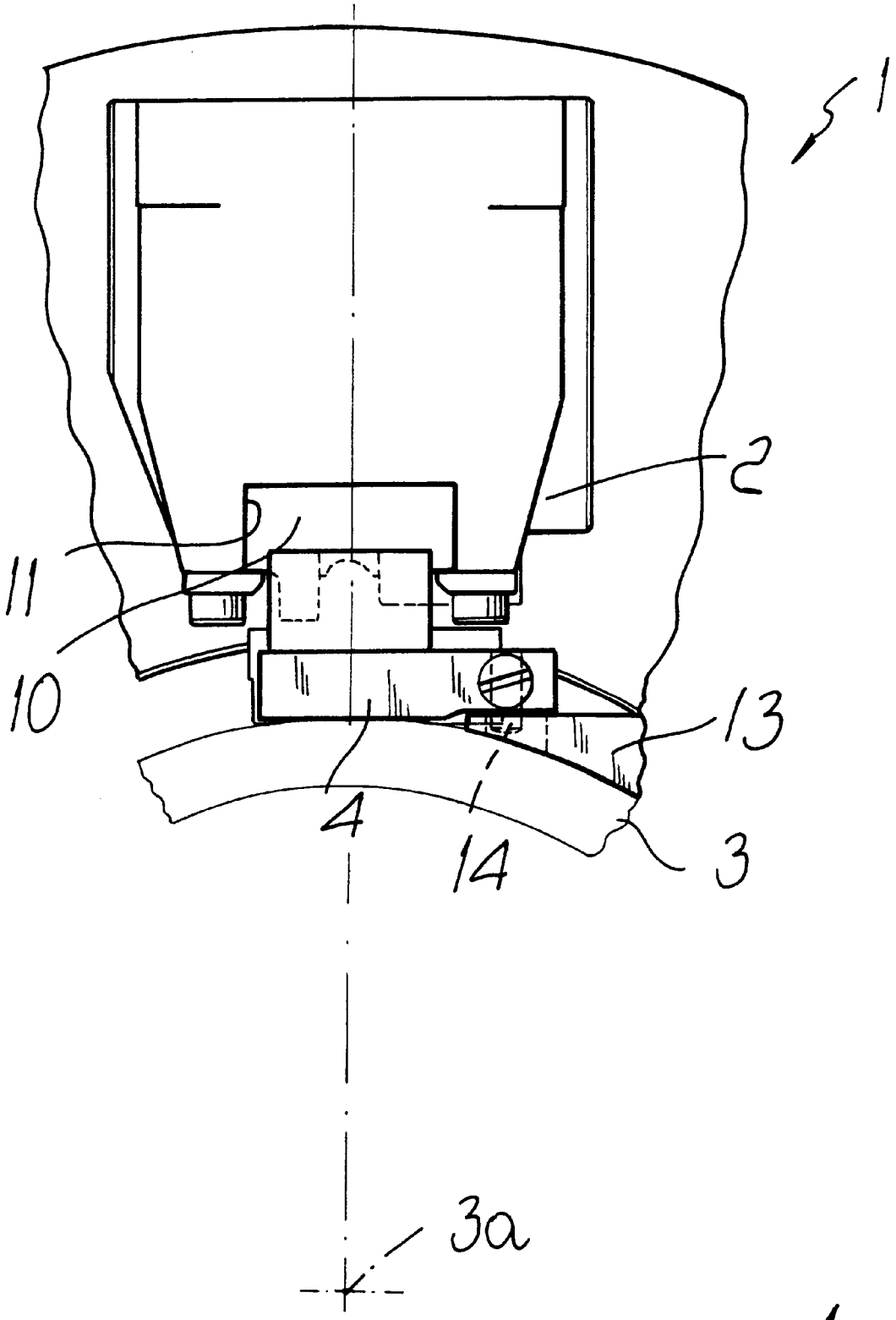
FIG. 1 is a partially sectional top plan view of the device according to the invention, arranged laterally adjacent to the needle cylinder of a hosiery knitting machine, which is shown only partially for the sake of simplicity.
Figure 2:
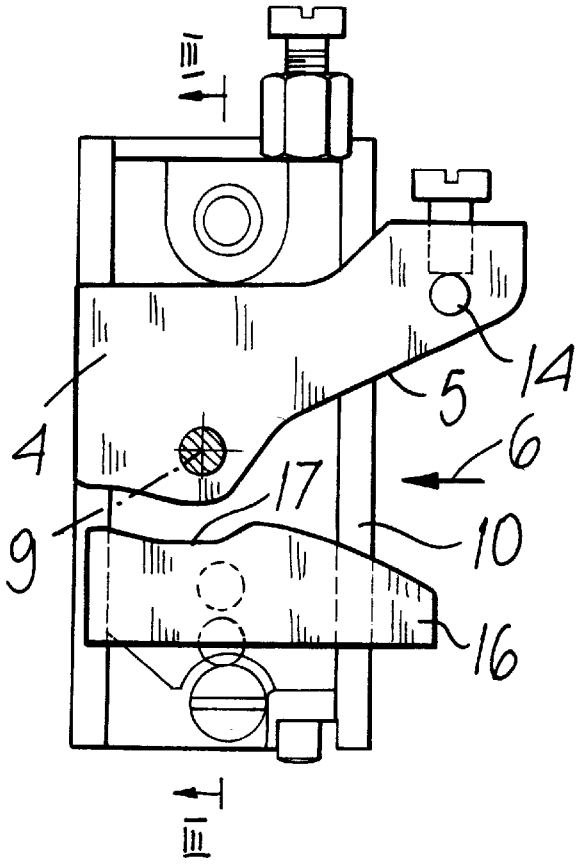
FIG. 2 is a view of part of the device of FIG. 1, taken from the side that is meant to be directed toward the needle cylinder of the machine.
Figure 3:
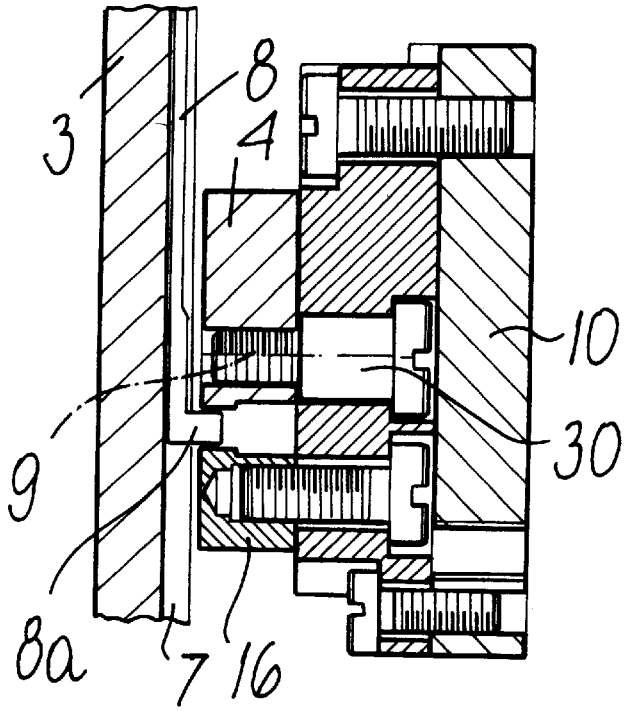
FIG. 3 is a sectional view of FIG. 2, taken along the plane III—III.

With reference to the above Figures, the device according to the invention, generally designated by the reference numeral 1, comprises a cam supporting surface 2 which faces a needle supporting element 3 and supports at least one casting-off cam 4, which has a profile 5 which is inclined with respect to the direction of motion 6 of the needle supporting element 3 with respect to the cam supporting surface 2.

The needle supporting element 3, depending on the machine on which the device according to the invention is meant to be installed, can be substantially flat, in the case of rectilinear hosiery knitting machines, or can be cylindrical and be constituted by the needle cylinder of a circular hosiery knitting machine, as shown in the accompanying Figures, or can also be constituted by the dial of a circular hosiery knitting machine of the cylinder and dial type.

A plurality of slots 7 are formed on the face of the needle supporting element 3 that is directed toward the cam supporting surface 2 and run parallel to each other and at right angles to the direction of motion 6. In the illustrated case, which relates to a circular knitting machine, the slots 7 are formed in the lateral surface of the needle cylinder and run parallel to the axis 3*a* of the needle cylinder.

A needle 8 is accommodated inside each slot 7, can slide along the corresponding slot 7 and has a heel 8*a* which protrudes from the slot 7 and can engage the profile 5 of the casting-off cam 4.

It should be noted that the movement of the needle 8 along the corresponding slot 7, instead of being produced by the engagement of its heel 8*a* with the casting-off cam 4 and with the other cams that are associated with the cam supporting surface 2, can be achieved by means of a needle pusher element, which is accommodated, together with the needle 8, inside a corresponding slot 7 and has a heel which can engage the profile 5 of the casting-off cam 4 and the other cams that are fitted on the cam supporting surface 2.

Thus, for example, if the machine that is equipped with the device according to the invention is a double-cylinder circular hosiery knitting machine, the needle pusher elements are constituted by sliders, or transfer sinkers which, by engaging with their heels the cams provided on the cam supporting surface, produce the movement of the needle located in the same slot of the needle cylinders.

According to the invention, the casting-off cam 4 is supported by the cam supporting surface 2 so that it can rotate about a first axis 9 which is substantially perpendicular to the surface of the portion of the needle supporting element 3 which, in each instance, faces the cam supporting surface 2. The casting-off cam 4 can rotate on command about the first axis 9, so as to vary the inclination of the profile 5 with respect to the direction of motion 6.

The rotation of the cam 4 about the first axis 9, through a preset angle, can be produced by means of a conventional actuator, for example a step motor, for example installed on the cam supporting surface 2 and connected to the casting-off cam 4 with its output shaft.

Advantageously, the casting-off cam 4 is pivoted about the first axis 9, by means of a pivot 30, to a slider 10 which is supported by the cam supporting surface 2 so that it can slide parallel to the extension of the slots 7.

More particularly, as shown in particular in FIG. 1, a seat 11 is formed in the cam supporting surface 2 and accommodates, so that it can slide parallel to the extension of the slots 7, the slider 10 on which a casting-off cam 4 is provided.

The slider 10 can move on command parallel to the extension of the slots 7, in the illustrated case, parallel to the axis 3*a* of the needle cylinder 3, in a per se known manner in order to vary the length of the loops of knitting.

Advantageously, the casting-off cam 4, in addition to being pivoted to the slider 10 about the first axis 9, is also pivoted, with a portion thereof which is spaced from the first axis 9, to a portion 13 of the cam supporting surface 2 about a second axis 12 which is substantially parallel to the first axis 9.

The pivoting of the casting-off cam 4 to the portion 13 of the cam supporting surface 2 is provided by means of a pivot 14 which can slide inside a seat 15 formed in the portion 13; said seat 15 is elongated in a direction which is parallel to the direction of motion 6, so as to achieve a rotation of the casting-off cam 4 about the first axis 9 every time the position of the slider 10 is changed in a direction which is parallel to the extension of the slots 7, i.e., every time the length of the loops of knitting is changed.

In practice, by virtue of the connection provided between the casting-off cam 4 and the slider 10 and between said casting-off cam 4 and the portion 13 of the cam supporting surface 2, simply by varying the length of the loops of knitting the angle of the profile 5 of the casting-off cam 4 with respect to the direction of motion 6 is changed correspondingly. More particularly, the inclination of the profile 5 of the casting-off cam 4 is increased when the slider 10 is moved in the direction that increases the length of the loops of knitting.

In this manner a higher inclination of the profile 5 with respect to the direction of motion 6 is automatically achieved when long loops of knitting are formed and a lower inclination is achieved when short loops of knitting are formed.

For the sake of completeness in description, it is noted that a countercam 16 is mounted on the slider 10; the profile 17 of said countercam faces the profile 5 of the casting-off cam 4.

With the device according to the invention, by virtue of the possibility to vary the inclination of the profile 5 of the casting-off cam 4 with respect to the direction of motion of the needle supporting element 3 relative to said casting-off cam 4, it is possible to adapt said inclination to the various knittings that can be performed with the hosiery knitting machine or the like.

Figure 4:
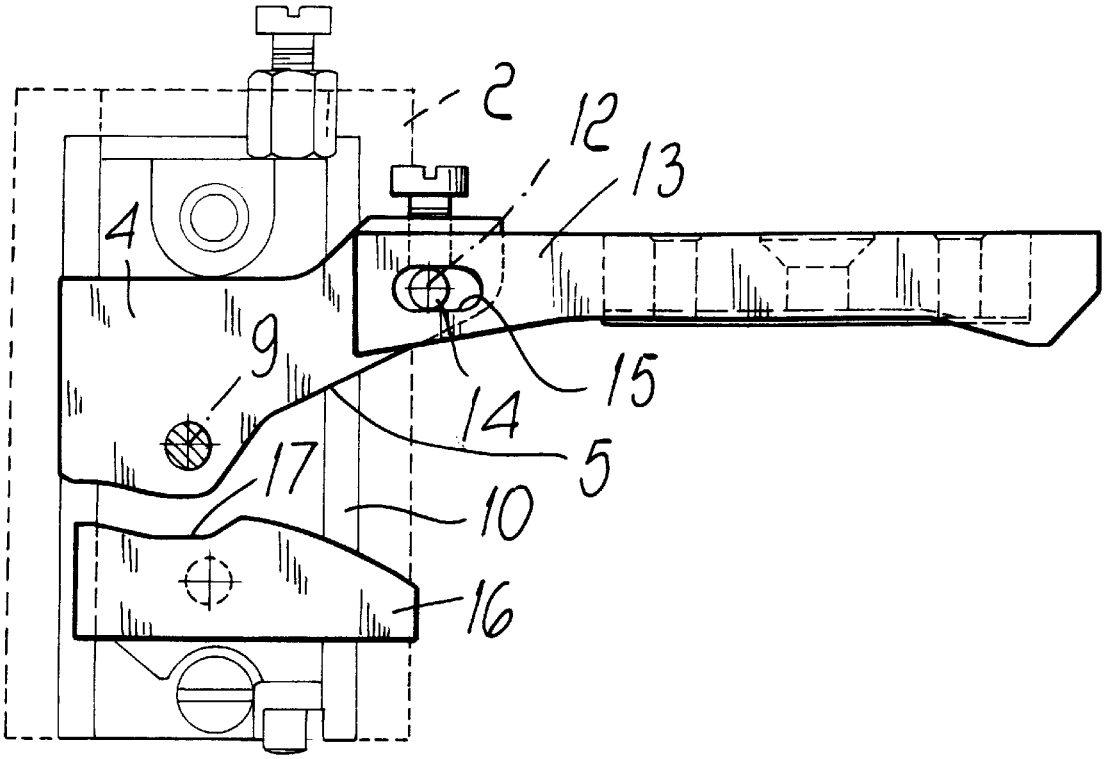
FIG. 4 is a schematic view of a portion of the cam supporting surface, taken from the side that is meant to be directed toward the needle cylinder, with the casting-off cam in a first position.
Figure 5:
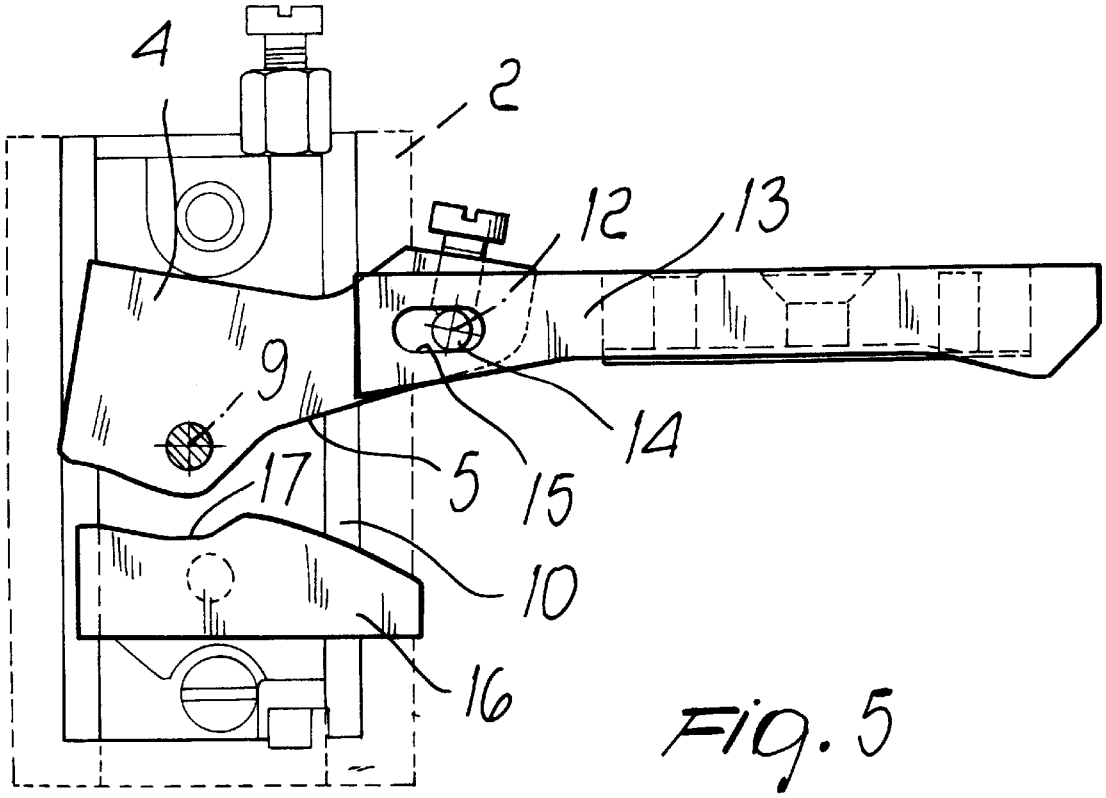
FIG. 5 is a view, similar to FIG. 4, of a portion of the cam supporting surface with the casting-off cam in a second position.

In particular, during the formation of very long loops, when a higher inclination is required, the cam 4 assumes the position shown in FIG. 4, so as to reduce the friction of the yarn used to form new loops on the sinkers or in any case on the points where said yarn rests laterally to the needles, while during knitting with short loops of knitting such inclination can be reduced, as shown in FIG. 5, so as to allow faster operation of the machine without causing excessive wear of the heels of the needles or of the needle pusher elements and of said casting-off cam.

In practice it has been observed that the device according to the invention fully achieves the intended aim and objects, since by allowing a variation in, according to production requirements, the inclination of the profile of the casting-off cam with respect to the direction of motion of the needle supporting element relative to the cam supporting surface, it allows an increase in the productivity of the machine on which it is mounted and to reduce the wear of the needles, or of the needle pusher elements, and of the casting-off cam itself.

Another advantage is that it is possible to reduce the degree of tension of the yarn during the formation of the loops of knitting.

Although the invention has been described in its application to a single-cylinder circular hosiery knitting machine, it can in any case be used advantageously, as explained, in other knitting machines for hosiery or the like.

The device thus conceived is susceptible of numerous modifications and variations, all of which are within the scope of the inventive concept; all the details may further be replaced with other technically equivalent elements.

In practice, the materials used, as well as the dimensions, may be any according to requirements and to the state of the art.

What is claimed is:

1. A combination of an needle actuation device and a knitting machine provided with a plurality of needles and engagement heels, and with a feed where knitting yarn is taken up for forming knitting loops, the combination comprising: a needle supporting element movable in a selectable direction of motion; at least one casting-off cam supported at said needle supporting element; a cam supporting surface which faces said needle supporting element, said at least one casting-off cam having a profile arranged at an angle to the direction of motion in which said needle supporting element moves with respect to said cam supporting surface, said profile of the casting-off cam being engageable by said engagement heels which protrude from said needle supporting element toward said cam supporting surface; a plurality of slots which are substantially at right angles to said direction of motion provided at said needle supporting element on a face thereof directed toward said cam supporting surface, each of said slots accommodating a needle which is slideable along the corresponding slot, said profile of the casting-off cam producing a movement of a said needle, along a corresponding slot of the needle supporting element, after the yarn has been taken up at the feed of the machine, in order to form new loops of knitting, and casting off previously formed loops of knitting, said casting-off cam being supported at said cam supporting surface so as to rotate about a first axis which is substantially perpendicular to a surface of a portion of said needle supporting element that faces in each instance said cam supporting surface, rotation of said casting-off cam about said first axis being controllable by control means for providing a variation in inclination of said profile with respect to said direction of motion and for providing a variation in a length of the loops of knitting.

2. A combination of an needle actuation device and a knitting machine provided with a plurality of needles and engagement heels, and with a feed where knitting yarn is taken up for forming knitting loops, the combination comprising: a needle supporting element movable in a selectable direction of motion; at least one casting-off cam supported at said needle supporting element; a cam supporting surface which faces said needle supporting element, said at least one casting-off cam having a profile arranged at an angle to the direction of motion in which said needle supporting element move with respect to said cam supporting surface, said profile of the casting-off cam being engageable by said engagement heels which protrude from said needle supporting element toward said cam supporting surface; a plurality of slots which are substantially at right angles to said direction of motion provided at said needle sporting element on a face thereof directed toward said cam supporting surface, each of said slots accommodating a needle which is slideable along the corresponding slot, said profile of the casting-off cam producing a movement of a said needle, along a corresponding slot of the needle supporting element, after the yarn has been taken up at the feed of the machine, in order to form new loops of knitting, and casting off previously formed loops of knitting, said casting-off cam being supported at said cam supporting surface so as to rotate about a first axis which is substantially perpendicular to a surface of a portion of said needle supporting element that faces in each instance said cam supporting surface, rotation of said casting-off cam about said first axis being controllable by control means for providing a variation in inclination of said profile with respect to said direction of motion, the combination further comprising a slider to which said casting-off cam is pivoted, about said first axis and which is supported by said cam supporting surface so as to slide in a sliding direction which is substantially parallel to an extension of said slots, said slider being movable on command with respect to said cam supporting surface in said sliding direction by said control means for providing a variation of a length of the loops of knitting.

3. The combination of claim 2, comprising an articulation, said casting-off cam being articulated at said articulation, with a portion thereof which is spaced from said first axis, to said cam supporting surface about a second axis which is parallel to said first axis for a rotation of said casting-off cam as a consequence of a movement of said slider along said sliding direction with respect to said cam supporting surface.

4. The combination of claim 2, wherein said needle supporting element is constituted by a needle cylinder of a circular knitting machine.

5. A combination of an needle actuation device and a knitting machine provided with a plurality of needles and engagement heels, and with a feed where knitting yarn is taken up for forming knitting loops, the combination comprising: a needle supporting element movable in a selectable direction of motion; at least one casting-off cam supported at said needle supporting element; a cam supporting surface which faces said needle supporting element, said at least one casting-off cam having a profile arranged at an angle to the direction of motion in which said needle supporting element moves with respect to said cam supporting surface, said profile of the casting-off cam being engageable by said engagement heels which protrude from said needle supporting element toward said cam supporting surface; a plurality of slots which are substantially at right angles to said direction of motion provided at said needle supporting element on a face thereof directed toward said cam supporting surface, each of said slots accommodating a needle which is slideable among the corresponding slot, said profile of the casting-off cam producing a movement of said needle, along a corresponding slot of the needle supporting element, after the yarn has been taken up at the feed of the machine, in order to form new loops of knitting, and casting off previously formed loops of knitting, said casting-off cam being supported at said cam supporting surface so as to rotate about a first axis which is substantially perpendicular to a surface of a portion of said needle supporting element that faces in each instance said cam supporting surface, rotation of said casting-off cam about said first axis being controllable by control means for providing a variation in inclination of said profile with respect to said direction of motion, the combination further comprising a circular knitting machine of a cylinder and dial type provided with a dial, and with a needle cylinder, said needle supporting element being constituted by the dial of the circular knitting machine.

* * * * *